United States Patent [19]

Alley

[11] 4,292,987

[45] Oct. 6, 1981

[54] FINGERNAIL HONE

[75] Inventor: David W. Alley, Houston, Tex.

[73] Assignee: Neal J. Mosely, Houston, Tex. ; a part interest

[21] Appl. No.: 145,441

[22] Filed: May 1, 1980

[51] Int. Cl.[3] ..... A45D 29/00

[52] U.S. Cl. ..... 132/73; 132/76.4

[58] Field of Search ..... 132/73, 75.6, 76.4; 128/355

[56] References Cited

U.S. PATENT DOCUMENTS

| | | | |
|---|---|---|---|
| 243,671 | 6/1881 | Wilson | 132/75.6 |
| 2,516,423 | 7/1950 | Roe | 132/75.6 |
| 2,672,148 | 3/1954 | Madden | 132/76.4 |
| 3,298,381 | 1/1967 | Adams | 132/76.4 |

*Primary Examiner*—G. E. McNeill

*Attorney, Agent, or Firm*—Neal J. Mosely

[57] ABSTRACT

A novel fingernail hone consists of a body of unglazed ceramic material having a honing or polishing surface in the form of a concave surface which is unglazed and of substantially spherical curvature. The ceramic material is preferably in the form of an elongated stick, preferably of cylindrical shape, with the concave unglazed surface in either or both ends. An alternate embodiment may include a sharpening or polishing notch in one end or extending longitudinally of the cylindrical surface of the ceramic stick.

8 Claims, 8 Drawing Figures

FINGERNAIL HONE

BACKGROUND OF THE INVENTION

1. FIELD OF THE INVENTION

This invention relates to new and useful improvements in hones for finishing and polishing fingernails after shaping with a nail file or emery board.

2. BRIEF DESCRIPTION OF THE PRIOR ART

Fingernail files for shaping and finishing fingernails are well known in the prior art. Nail files are made with a roughened surface obtained by cross cuts or, in some cases, by abrasive material imbedded in the surface of the nail. Fingernail files usually have a course side for shaping and a fine side for smoothing or finishing.

Emery boards are also well known in the prior art for use in shaping and finishing fingernails. Emery boards consist of an abrasive sandpaper or emery paper cemented on a flat board. One side of the emery board is usually quite course for shaping and the other side has a fine finish for finishing.

SUMMARY OF THE INVENTION

A novel fingernail hone which constitutes a preferred embodiment of this invention consists of a body of unglazed ceramic material have a honing or polishing surface in the form of a concave surface which is unglazed and of a substantially spherical curvature. The ceramic material is preferably in the form of an elongated stick, preferably of cylindrical shape, with the concave unglazed surface in either or both ends. An alternate embodiment may include a sharpening or polishing notch in one end or extending longitudinally of the cylindrical surface of the ceramic stick. This hone is particularly useful in finishing and polishing fingernails after rough shaping by a fingernail file or emery board.

DESCRIPTION OF THE PREFERRED EMBODIMENTS

Figure 1:
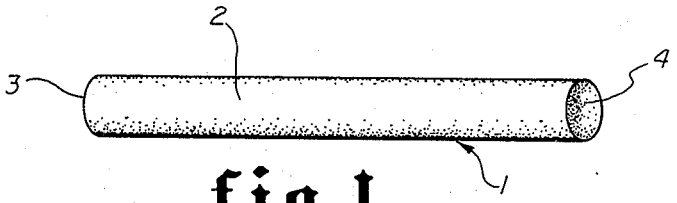
FIG. 1 is an isometric view of a fingernail hone representing a preferred embodiment of this invention.
Figure 2:
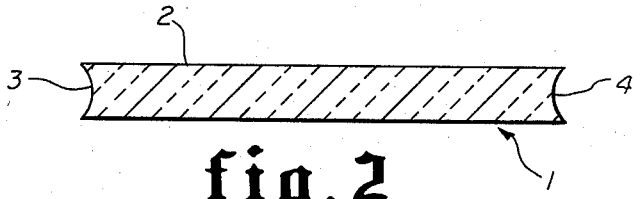
FIG. 2 is a view in longitudinal section of the fingernail hone shown in FIG. 1.

Referring to the drawings by numerals of reference, and more particularly to FIGS. 1 and 2, there is shown a fingernail hone 1 which consists of a body of ceramic material. Fingernail hone 1 is preferably in the form of an elongated stick 2 of cylindrical shape having end surfaces 3 and 4 which are of concave shape. Surfaces 3 and 4 are unglazed and of a fine abrasive texture and have a substantially spherical curvature. The entire fingernail hone 1 is preferably of unglazed ceramic material, although the outer cylindrical surface of cylindrical stick 2 could be glazed, if desired, provided that the concave end surfaces 3 and 4 are unglazed.

The size and shape of the fingernail hone 1 is largely a matter of personal preference. It preferably has a diameter about the thickness of a human finger. Obviously, this can vary considerably in size but the hone will function satisfactorily as long as it contains the concave unglazed surfaces. This fingernail hone can be used with either hand by placing the concave end onto the fingernail, which has been previously shaped by a nail file or emery board, and moving either the fingernail or the hone in a relative radial motion. This hone is small in size and easily carried in a pocket or purse and is very efficient in producing a highly polished end on a nail which has been shaped by a nail file or emery board.

Figure 3:
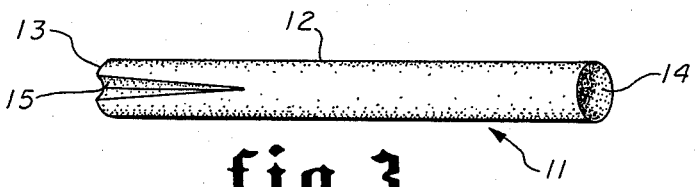
FIG. 3 is an isometric view of an alternate embodiment of the fingernail hone.
Figure 5:
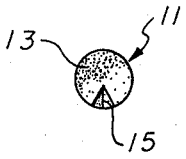
FIG. 5 is an end view of the fingernail hone shown in FIG. 3.
Figure 4:
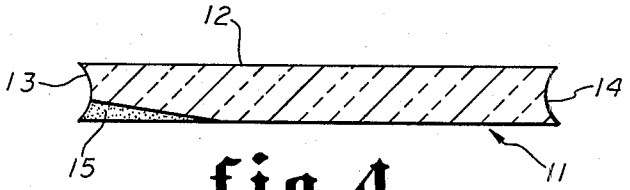
FIG. 4 is a view in central section, through the notch, of the fingernail hone shown in FIG. 3.

In FIGS. 3 to 5, there is shown an alternate embodiment of this invention. In FIG. 3, there is shown a fingernail hone 11 which consists of an elongated stick 12 of ceramic material. The ceramic material may be glazed or unglazed on the outer cylindrical surface. The left end 13 of ceramic stick 12 may be flat or concave as in the case of the end surface 3 in FIG. 1. The right end 14 of ceramic stick 12 is concave in shape and unglazed as in the case of the concave surface 4 in FIGS. 1 and 2. At the left end of stick 12 there is provided a notch 15 which extends partly in a radial direction of the end surface 13 and partly in a longitudinal direction of the ceramic stick 12. Notch 15 is useful in shaping the ends and edges of the fingernail.

Figure 6:
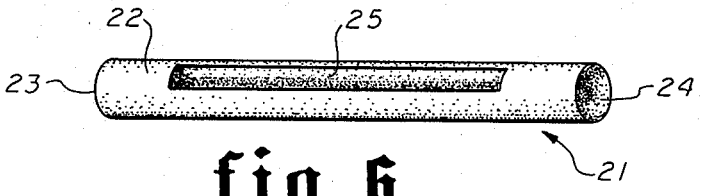
FIG. 6 is an isometric view of still another embodiment of the fingernail hone and having a longitudinally extending finishing notch.
Figure 8:
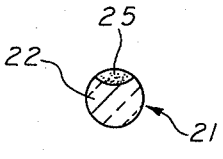
FIG. 8 is a sectional view taken on the line 8—8 of FIG. 7 illustrating the longitudinal notch of the hone shown in FIGS. 6 and 7.
Figure 7:
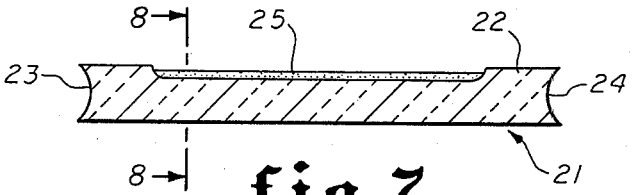
FIG. 7 is a view in longitudinal section of the fingernail hone shown in FIG. 6.

In FIGS. 6–8, there is shown still another embodiment of the fingernail hone. In FIG. 6 there is shown a fingernail hone 21 which consists of a stick 22 of ceramic material. Stick 22 has concave ends 23 and 24 which are spherically curved ceramic surfaces of unglazed ceramic. Stick 22 also has a longitudinally extending notch 25 which provides a more extended surface for finishing and polishing.

The three embodiments of the fingernail hone shown in the drawings and described above are each capable of producing a smooth fine highly polished surface on the end and edges of a nail which has previously been shaped with a nail file or emery board. The polishing is accomplished by the very fine texture of the unglazed ceramic surface which is contacted with the fingernail during use of the fingernail hone.

While this invention has been described fully and completely with special emphasis upon several preferred embodiments, it should be understood that within the scope of the appended claims the invention may be practiced otherwise than as specifically described herein.

I claim:

1. A fingernail hone for polishing and smoothing fingernails comprising a body of ceramic material having a concave unglazed surface of substantially spherical curvature, and said unglazed surface being substantially smooth, uncoated and free from additional abrasive and constituting the sole abrasive surface for use in polishing and smoothing fingernails.

2. A fingernail hone according to claim 1 in which said ceramic body is an elongated stick having said concave unglazed surface in at least one end thereof.

3. A fingernail hone according to claim 2 in which said elongated stick has concave unglazed surfaces in each end.

4. A fingernail hone according to claim 2 in which said elongated stick has a longitudinally extending notch in the surface thereof.

5. A fingernail hone according to claim 2 in which said elongated stick has a radially and longitudinally extending notch in one end thereof.

6. A fingernail hone according to claim 2 in which said elongated stick is cylindrical.

7. A fingernail hone according to claim 6 in which said stick has a longitudinally extending unglazed notch in the cylindrical peripheral surface thereof.

8. A fingernail hone according to claim 6 in which said stick has a radially and longitudinally extending notch in one end thereof.

* * * * *